US010895109B2

(12) United States Patent
Squires

(10) Patent No.: US 10,895,109 B2
(45) **Date of Patent: *Jan. 19, 2021**

(54) STEP EXTENSION ASSEMBLY FOR TREE STAND AND KIT INCLUDING THE SAME

(75) Inventor: Timothy P. Squires, Williamsburg, MI (US)

(73) Assignee: Hurricane Safety Systems, LLC, Traverse City, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/555,260

(22) Filed: Jul. 23, 2012

(65) Prior Publication Data

US 2014/0020979 A1 Jan. 23, 2014

(51) Int. Cl.

| | |
|---|---|
| ***E06C 1/38*** | (2006.01) |
| ***E06C 1/39*** | (2006.01) |
| ***E06C 7/16*** | (2006.01) |
| ***E06C 7/18*** | (2006.01) |

(52) U.S. Cl.

CPC ..... *E06C 1/381* (2013.01); *E06C 7/16* (2013.01); *E06C 7/181* (2013.01)

(58) Field of Classification Search

CPC . E06C 7/00; E06C 1/381; E06C 7/081; E06C 7/082; E06C 7/083; E06C 7/14; E06C 7/16; E06C 7/181; E06C 7/183; E06C 1/34; E06C 1/38; E06C 1/39; E06C 1/393; A45F 3/26

USPC ..... 182/135, 187, 188, 116, 119, 189, 129, 182/120, 121; 248/210, 238

See application file for complete search history.

(56) References Cited

U.S. PATENT DOCUMENTS

| | | | | | |
|---|---|---|---|---|---|
| 698,762 | A | * | 4/1902 | Tove | 182/53 |
| 1,098,945 | A | * | 6/1914 | Frederick | A01M 31/02 182/187 |
| 1,257,056 | A | * | 2/1918 | Wheatley | 182/116 |
| 1,285,817 | A | * | 11/1918 | Sklar | 182/120 |
| 1,358,277 | A | * | 11/1920 | Bochard | 248/210 |
| 1,435,988 | A | * | 11/1922 | Siemann et al. | 248/210 |
| 1,515,420 | A | * | 11/1924 | Traylor | E06C 1/397 182/103 |
| 2,051,060 | A | * | 8/1936 | Soman | 248/210 |
| 2,074,586 | A | * | 3/1937 | Heinrich et al. | 182/113 |
| 2,132,331 | A | * | 10/1938 | Wanamaker | D06F 73/00 182/129 |
| 2,392,538 | A | * | 1/1946 | Knudsen | 182/134 |
| 2,486,783 | A | | 11/1949 | Hartman et al. | |

(Continued)

OTHER PUBLICATIONS

Definition of 'complementary' provided in Action The American Heritage® Dictionary of the English Language, Fourth Edition copyright © 2000 by Houghton Mifflin Company. Updated in 2009. Published by Houghton Mifflin Company. All rights reserved.*

(Continued)

*Primary Examiner* — Daniel P Cahn

(74) *Attorney, Agent, or Firm* — Dinsmore & Shohl LLP

(57) ABSTRACT

A step extension assembly for a tree stand includes a ladder having rungs supported by at least one ladder rail. A bracket frame including attachment portions is attached to the at least one ladder rail. A step base is attached to the bracket frame. The step base includes a stepping surface for supporting a foot of a user. The step base is positioned laterally outboard relative to the at least one ladder rail providing an extended support for a user when entering and exiting the tree stand.

22 Claims, 6 Drawing Sheets

(56) References Cited

U.S. PATENT DOCUMENTS 2,565,014 A * 8/1951 Beaty ..... E06C 7/14 118/500
2,570,555 A * 10/1951 Hudoba ..... E06C 7/14 211/86.01
2,585,150 A * 2/1952 McGill ..... E06C 7/08 182/120
2,643,045 A * 6/1953 Renfro ..... E06C 1/38 108/96
2,718,378 A * 9/1955 Lutton ..... 254/390
2,745,703 A * 5/1956 Rose ..... 182/187
2,833,503 A * 5/1958 Harshbarger ..... E04G 5/06 182/113
2,871,067 A 1/1959 Brogdon
2,881,028 A * 4/1959 Baird ..... E06C 7/16 182/113
2,897,013 A * 7/1959 Delp ..... E04G 7/16 182/108
2,982,337 A * 5/1961 Arena ..... A01M 31/02 182/187
3,011,587 A * 12/1961 Mallog ..... E04G 5/045 182/150
3,019,851 A * 2/1962 Doss ..... E06C 1/381 182/111
3,246,867 A * 4/1966 Ewing ..... E06C 7/14 24/486
3,270,997 A * 9/1966 Gethmann ..... E04G 1/00 182/113
3,313,507 A * 4/1967 Belli ..... B44D 3/14 248/211
3,345,028 A * 10/1967 Lawrie ..... F21V 37/00 248/230.8
3,493,208 A * 2/1970 Masataro ..... E04G 5/06 182/186.9
3,684,058 A * 8/1972 Brown ..... E04G 1/14 182/132
3,707,242 A * 12/1972 Golden et al. ..... 220/570
3,717,220 A * 2/1973 Donker ..... E04G 5/06 182/129
3,822,847 A * 7/1974 Emmons ..... E06C 7/14 108/152
3,833,090 A * 9/1974 Georgianna ..... E06C 9/04 182/92
3,899,045 A * 8/1975 Geisel et al. ..... 182/121
3,955,645 A * 5/1976 Dye ..... 182/135
3,987,993 A * 10/1976 Hopkins ..... E06C 7/14 248/110
4,085,819 A * 4/1978 Ohnstad ..... 182/121
4,263,983 A 4/1981 Norton
4,284,095 A * 8/1981 Norton ..... 135/21
4,303,145 A * 12/1981 Vazquez ..... E06C 7/183 182/106
4,411,335 A * 10/1983 Forrester ..... A01M 31/02 182/180.1
4,467,890 A * 8/1984 McCallum ..... E06C 1/34 182/100
4,595,076 A * 6/1986 Gober ..... A63B 27/00 182/135
4,620,610 A * 11/1986 Southard ..... A63B 27/00 182/228.1
4,699,347 A * 10/1987 Kuhnley ..... A47G 33/1213 248/230.8
4,784,239 A * 11/1988 Kirkman ..... A01M 31/02 108/152
4,809,815 A * 3/1989 Wallace ..... A63B 27/00 182/133
4,821,844 A * 4/1989 Huffman ..... E04G 5/06 182/130
4,886,143 A * 12/1989 Dubroc ..... A45F 3/26 182/142
4,892,170 A * 1/1990 O'Donnell ..... E06C 1/34 182/100
D306,488 S * 3/1990 Mosburg ..... D25/62
4,923,049 A * 5/1990 Kent ..... E06C 7/16 182/107
4,932,497 A * 6/1990 Raso ..... E06C 9/04 182/189
4,941,547 A * 7/1990 Livick ..... E06C 7/16 182/107
5,005,668 A * 4/1991 Nowlan ..... 182/121
5,099,952 A * 3/1992 Farrell ..... E06C 7/16 182/122
5,111,908 A * 5/1992 Reiter et al. ..... 182/92
5,131,496 A * 7/1992 White ..... 182/187
5,135,193 A * 8/1992 Parris ..... E06C 7/143 182/129
5,156,235 A * 10/1992 Preston ..... E04G 1/14 182/186.9
D335,354 S * 5/1993 Phillips ..... D25/68
5,361,869 A * 11/1994 Ledbetter ..... A63B 27/00 182/133
5,507,363 A * 4/1996 Tredup ..... 182/129
5,509,499 A 4/1996 Prejean
5,579,867 A * 12/1996 Jarrel ..... 182/206
5,647,452 A * 7/1997 Gauthier ..... E06C 7/16 182/107
5,711,399 A 1/1998 Wayne-Prejean
5,752,580 A 5/1998 Jenkins, Jr.
5,806,626 A * 9/1998 Jenkins, Jr. ..... 182/100
5,816,362 A 10/1998 Jenkins, Jr.
5,833,190 A * 11/1998 Bishop ..... E06C 7/16 108/106
5,857,542 A * 1/1999 Mason ..... E06C 7/08 182/92
5,975,241 A * 11/1999 Berish ..... A63B 27/00 182/136
6,003,632 A 12/1999 Miller
6,009,976 A * 1/2000 Gorney ..... E06C 7/14 182/129
6,105,911 A * 8/2000 Olexson ..... E06C 7/14 248/210
6,148,836 A * 11/2000 Cananzey ..... 135/87
6,148,957 A 11/2000 Ahl et al.
6,148,958 A 11/2000 Ahl et al.
6,170,609 B1 * 1/2001 Dech ..... A01M 31/02 182/100
6,352,135 B1 * 3/2002 Jones ..... E06C 7/143 182/120
6,533,069 B1 * 3/2003 Couillard ..... E06C 1/34 182/107
6,547,035 B1 4/2003 D'Acquisto
6,668,975 B2 * 12/2003 Skipper ..... 182/100
6,752,243 B1 * 6/2004 Terzini ..... A47B 57/56 182/134
6,840,186 B1 * 1/2005 Steele ..... F16G 11/00 114/218
6,983,824 B1 * 1/2006 Dandurand ..... 182/82
7,017,710 B2 * 3/2006 Booysen ..... E04G 1/14 182/151
7,210,558 B2 * 5/2007 Eaves ..... E04G 1/28 182/115
7,454,859 B2 * 11/2008 Buckner ..... 42/94
7,735,606 B1 * 6/2010 Norton ..... E04G 5/147 182/186.6
7,861,826 B2 * 1/2011 Meyers et al. ..... 182/121
7,958,968 B1 * 6/2011 Stabler ..... E04H 15/04 135/90
7,967,264 B1 * 6/2011 Peterson ..... E06C 7/143 182/115
8,556,035 B1 * 10/2013 Kendall ..... E06C 1/381 182/156
8,631,904 B1 * 1/2014 Wilds ..... E06C 7/16 182/116
8,695,762 B1 * 4/2014 Carter ..... A01M 31/02 182/115
9,045,940 B2 * 6/2015 Walters ..... E06C 7/143
9,409,055 B1 * 8/2016 Niemela ..... A63B 27/00
2002/0104939 A1 * 8/2002 Perrault ..... A63B 27/00 248/218.4

(56) References Cited

U.S. PATENT DOCUMENTS

2003/0141146 A1* 7/2003 Skipper ..... A01M 31/02 182/100
2003/0141147 A1* 7/2003 Skipper ..... E06C 7/084 182/100
2003/0178255 A1* 9/2003 Auer ..... 182/187
2004/0112676 A1* 6/2004 Skipper ..... A01M 31/02 182/116
2005/0016795 A1* 1/2005 Skipper ..... A01M 31/02 182/100
2005/0230186 A1* 10/2005 Bigard ..... A01M 31/02 182/100
2007/0114096 A1* 5/2007 Skipper ..... E06C 1/381 182/116
2007/0240935 A1 10/2007 O'Brien et al.
2008/0105490 A1* 5/2008 Butcher ..... 182/116
2008/0128204 A1* 6/2008 Engstrom ..... 182/116
2009/0045012 A1* 2/2009 Mencl ..... A63B 27/00 182/92
2009/0095569 A1* 4/2009 Cooper ..... A01M 31/02 182/187
2009/0218165 A1* 9/2009 Maurer ..... A63B 27/04 182/112
2009/0229916 A1* 9/2009 Berkbuegler ..... A01M 31/02 182/113
2011/0011676 A1* 1/2011 DeLair ..... E06C 1/345 182/129
2011/0079467 A1* 4/2011 Mares ..... E06C 7/14 182/129
2011/0114416 A1 5/2011 Mayhew
2012/0012424 A1* 1/2012 Bowman ..... E06C 7/16 182/129
2012/0024630 A1* 2/2012 VanLaningham ..... A01M 31/02 182/116
2012/0080266 A1* 4/2012 Brock ..... E04G 3/243 182/107
2012/0211306 A1* 8/2012 Benefield ..... E06C 7/16 182/115
2014/0196988 A1* 7/2014 Jones ..... A63B 27/00 182/187
2014/0311828 A1* 10/2014 Bassett ..... A01M 31/02 182/124

OTHER PUBLICATIONS

Definition of "ladder" provided in Action The American Heritage® Dictionary of the English Language, Fourth Edition copyright © 2000 by Houghton Mifflin Company. Updated in 2009. Published by Houghton Mifflin Company. All rights reserved.*

* cited by examiner

STEP EXTENSION ASSEMBLY FOR TREE STAND AND KIT INCLUDING THE SAME

FIELD OF THE INVENTION

The invention relates to step extensions for climbing trees and other objects and to climbing kits for climbing trees and other objects.

BACKGROUND OF THE INVENTION

Typically tree stands and hunting blinds may be positioned in a tree above a surface of the ground to allow a hunter a broader view of a hunting area. Often a hunter must climb up a ladder or other device to enter the tree stand. As a hunter climbs up the ladder and is positioned to enter the tree stand, the hunter may often have to hold onto the tree and swing himself into the tree stand.

It would be desirable for a hunter to have a grip or other assisting mechanism attached to the tree to allow the hunter a secure handhold on the tree while entering the tree stand. It would also be desirable to have a climbing ladder that has an increased lateral stepping area to provide support when entering and exiting a tree stand.

There is therefore a need in the art for a step extension that may be attached to a ladder at a desired position to provide an increased later step or foot support when entering and leaving a tree stand. There is also a need in the art for a kit that may be attached to a tree at a desired position to allow a secure grip on the tree when entering and leaving a tree stand and provide an increased lateral area for foot support. There is also a need in the art for a kit that may be removably attached to various objects such as a tree or pole to allow a secure hand grip when climbing the object.

SUMMARY OF THE INVENTION

In one aspect, there is disclosed step extension assembly for a tree stand. The step extension assembly includes a ladder having rungs supported by at least one ladder rail. The step extension assembly includes a bracket frame, the bracket frame including attachment portions for connecting to the at least one ladder rail. A step base is attached to the bracket frame. The step base includes a steeping surface for supporting a foot of a user. The step base is positioned laterally outboard relative to the at least one ladder rail providing an extended support for a user when entering and exiting the tree stand.

In another aspect, there is disclosed a climbing kit for a tree stand. The climbing kit includes a ladder having rungs supported by at least one ladder rail. The kit includes a bracket frame, the bracket frame including attachment portions for connecting to the at least one ladder rail. A step base is attached to the bracket frame. The step base includes a steeping surface for supporting a foot of a user. The step base is positioned laterally outboard relative to the at least one ladder rail providing an extended support for a user when entering and exiting the tree stand.

The kit includes a hand grip assembly for climbing a tree. The hand grip assembly includes a handle grip portion. A handle bracket is attached to the handle grip portion. At least one mounting bracket is attached to the handle bracket. The mounting bracket includes an angled shape for engaging a surface of the tree. A harness is attached to the handle bracket. The harness cinches about the tree and secures the hand grip assembly relative to the tree.

DETAILED DESCRIPTION OF THE PREFERRED EMBODIMENTS

Figure 1:
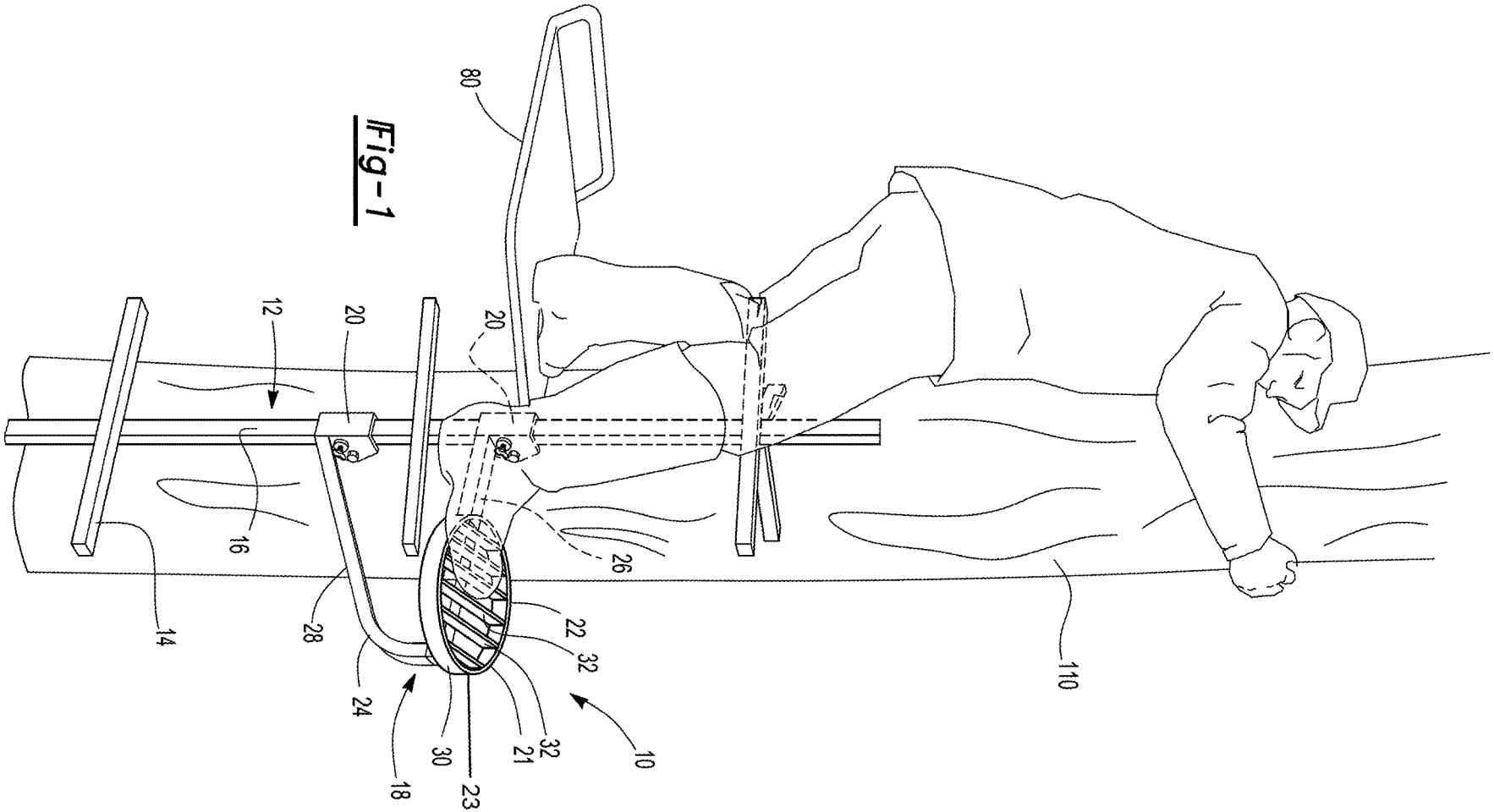
FIG. 1 is a partial perspective view of a person climbing up a tree stand ladder and entering a tree stand with a step extension assembly attached to the ladder.
Figure 2:
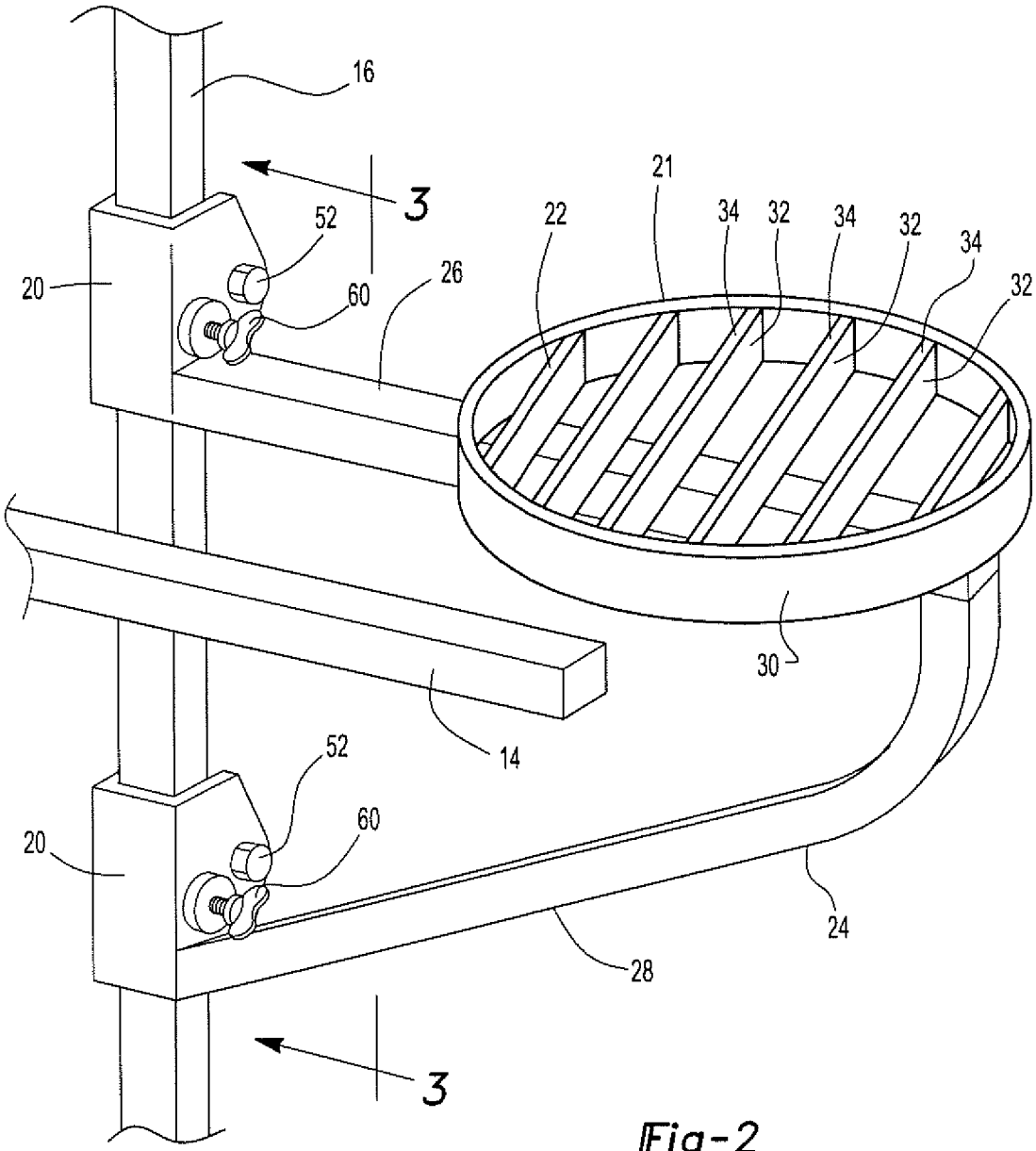
FIG. 2 is a partial perspective view of a step extension assembly attached to a ladder.
Figure 5:
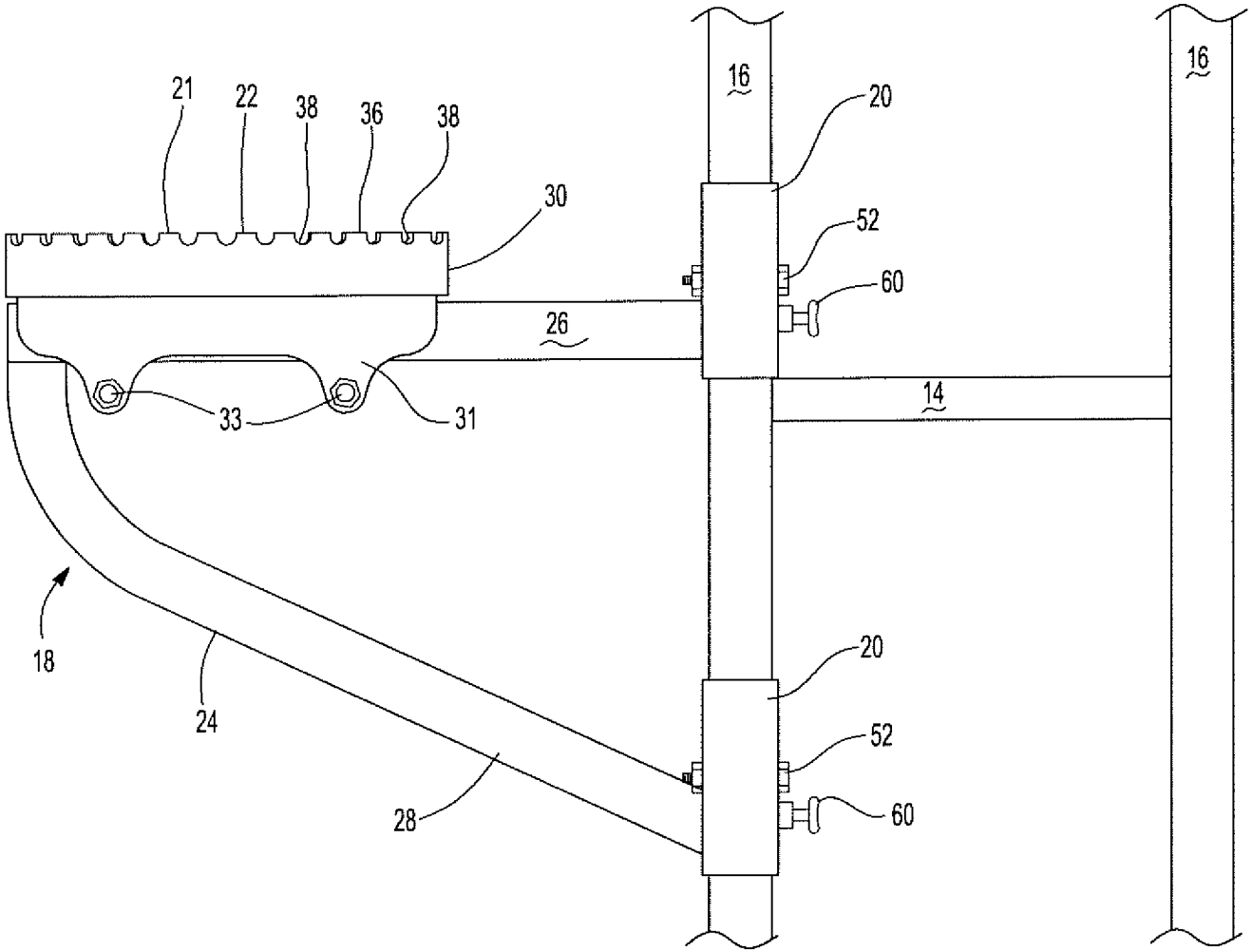
FIG. 5 is a partial front view of the step extension assembly attached to a ladder.
Figure 6:
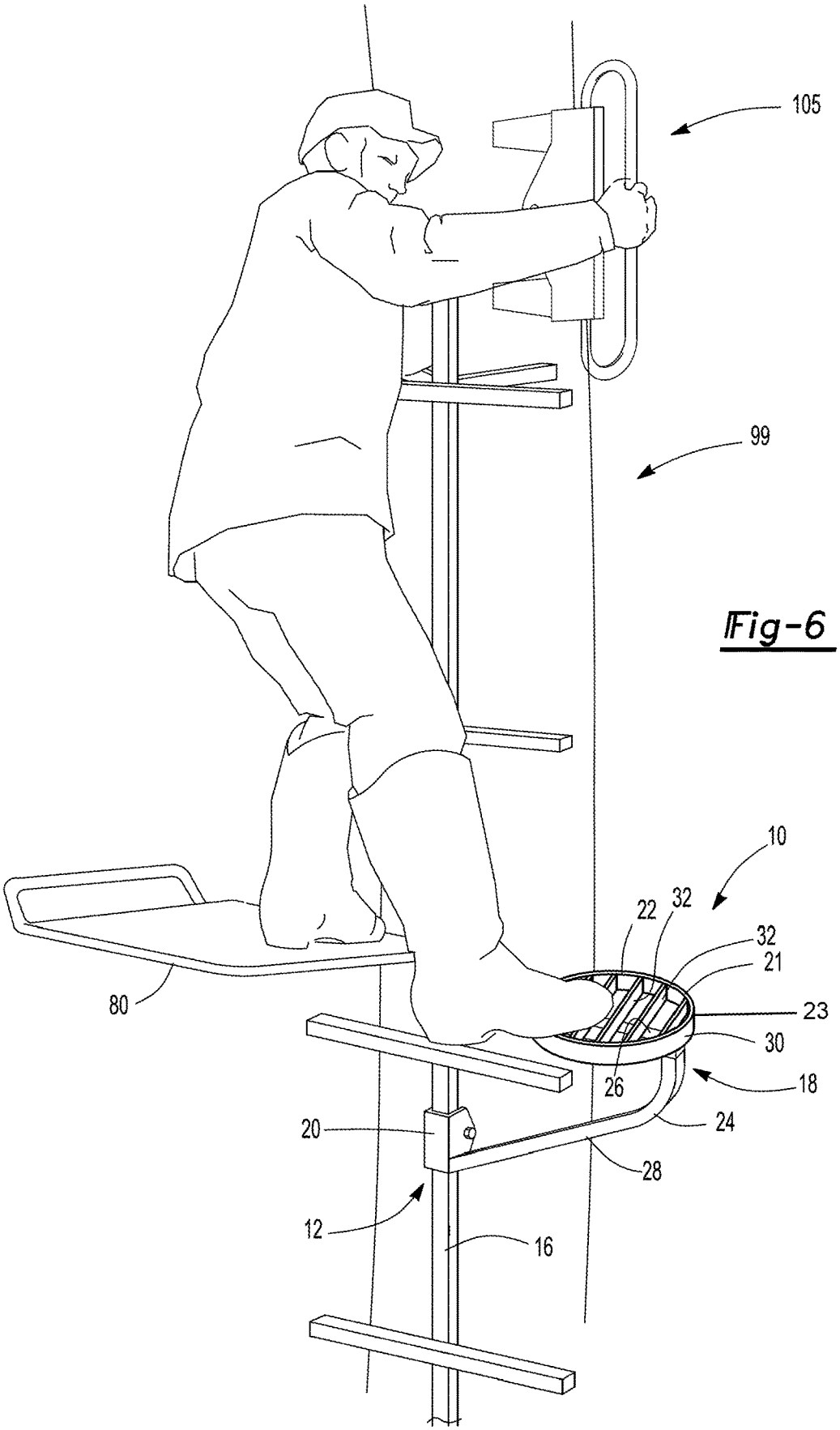
FIG. 6 is a partial perspective view of a person climbing up a tree stand ladder and entering a tree stand with a kit including a step extension assembly attached to the ladder and hand grip assembly attached to the tree.

Referring to FIGS. 1-5 there is shown a step extension assembly 10 for a tree stand. The step extension assembly includes a ladder 12 having rungs 14 supported by at least one ladder rail 16. The at least one ladder rail 16 may be positioned centrally with the rungs 14 extending from the single rail 16 as shown in FIG. 1 or the at least one rail 16 may include two rails 16 with the rungs 14 positioned between the rails 16 as shown in FIG. 5.

The step extension assembly 10 may include a bracket frame 18. The bracket frame 18 includes attachment portions 20 for connecting to the at least one ladder rail 16. A step base 21 is attached to the bracket frame 18. The step base 21 includes a stepping surface 22 for supporting a foot of a user. The step base 21 is positioned laterally outboard relative to the at least one ladder rail 16 providing an extended support 23 for a user when entering and exiting the tree stand.

In one aspect, the bracket frame 18 includes a rail 24 having a planar step mounting portion 26 and a support portion 28. The support portion 28 as shown in the figures may have a curved shape 30 and connect with the mounting portion 26. The support portion 28 and the mounting portion 26 terminate at the attachment portions 20.

The step base 21 includes a step frame 30 having a plurality of step rails 32 attached within the step frame 30. The step frame 30 may have various shapes and sizes. For example, the step frame 30 may be circular as shown in the figures or may have a square, rectangular or other shape. The step frame 30 may include an adjustment portion 31 that includes fasteners 33 allowing the step frame 30 to be moved along and secured on the support portion 28 to a desired position. The plurality of step rails 32 and step frame 30 includes upper surfaces 34, 36 supporting the foot of the user. In one aspect, the upper surfaces 34, 36 of the plurality of rails 32 and step frame 30 includes gripping structures 38 formed thereon. The gripping structures 38 may include notches, raised bumps, knurled patterns or other deformations that provide a secure footing for a user.

Figure 3:
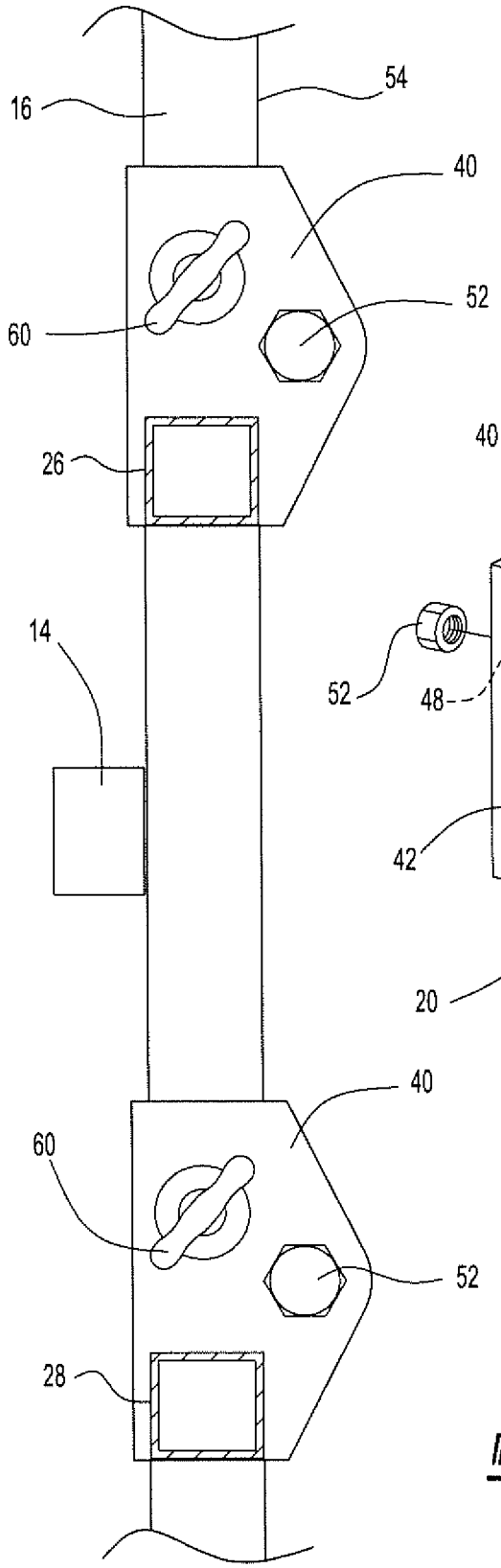
FIG. 3 is a partial side view of a step extension assembly attached to a ladder.
Figure 4:
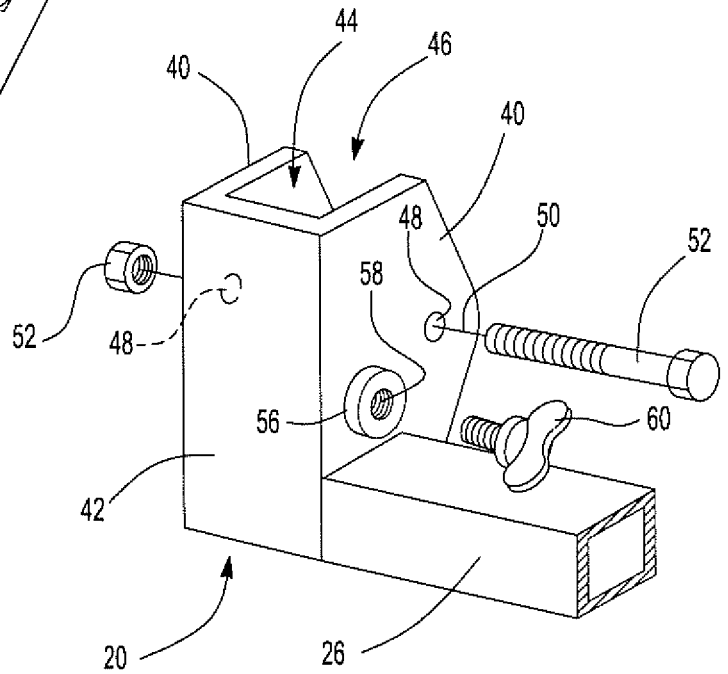
FIG. 4 is a partial perspective view of the attachment portion of the step extension assembly.

The attachment portions 20 include opposing sides 40 joined by a joining surface 42 defining a cavity 44 that receives the at least one ladder rail 16. The opposing sides 40 define an opening 46 allowing the ladder rail 16 to be positioned within the cavity 44. The opposing sides 40 include holes 48 formed there through on a common axis 50. The holes 48 receive a retaining fastener 52. In one aspect, the holes 48 are positioned in the opposing sides 40 such that the retaining fattener 52 is positioned on an outside surface 54 of the at least one ladder rail 16 when the ladder rail 16 is positioned within the cavity 44, as best seen in FIG. 3.

One of the opposing sides 40 includes an adjustment hole 56 formed therein. The adjustment hole 56 includes threads 58 formed therein receiving an adjustment fastener 60. The adjustment fastener 60 may be threaded into the adjustment hole 56 and contacts the at least one ladder rail 16 when the ladder rail 16 is positioned within the cavity 44. The adjustment fastener 60 may be tightened and loosened to allow a user to move the step extension assembly 10 along the ladder rail 16 to a desired position.

In use, a user may assemble the step extension assembly 10 by positioning the rail 16 of the ladder 12 within the cavity 44 of the attachment portions 20 with two attachment portions 20 being shown. It should be realized that various numbers of attachment portions 20 may be utilized. The retaining fastener 52 may then be positioned in the attachment holes 48 of the opposing sides 40 thereby securing the attachment portions 20 to the rail 16. A user may then slide the step extension assembly 10 to a desired position on the ladder rail 16 and then tighten the adjustment fastener 60 within the adjustment hole 56 on the opposing side 40 to fix the position of the attachment portion 20 relative to the ladder rail 16.

There is also disclosed a kit 99 that includes the step extension assembly 10 as described above and also includes a handle grip assembly 105 for climbing a tree or other object such as a pole or column 110. In one aspect, the hand grip assembly 105 includes a handle grip portion 115. At least one mounting bracket 120, with two being shown, may be connected with the handle grip portion 115. The mounting bracket 120 includes an angled shape 125 for engaging a surface of the tree 110. A harness 130 may be connected with the mounting bracket 120. The harness 130 cinches about the tree 110 and secures the mounting bracket 210 relative to the tree.

Figure 8:
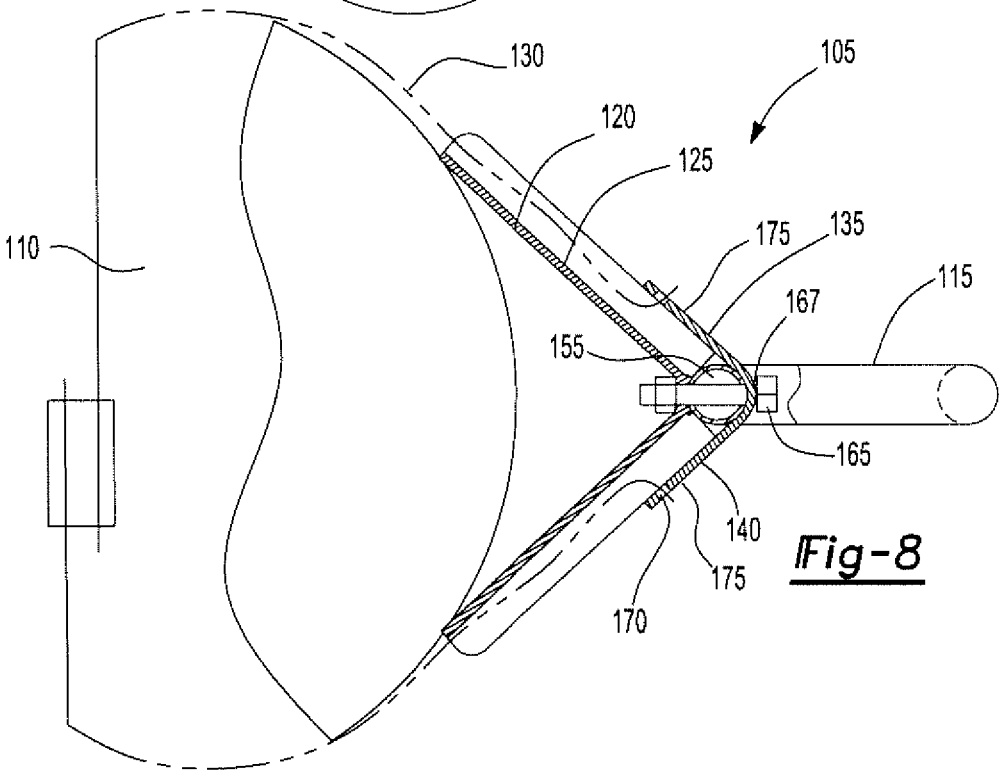
FIG. 8 is a side view of a handle grip assembly of the kit.

Referring to FIG. 8, a handle bracket 135 may be attached to the handle grip portion 115 and the at least one mounting bracket 120. In the detailed figure there are provided two mounting brackets 120 attached to the handle grip portion 115. In one aspect, the handle bracket 135 includes an angled shape 140 that is complementary with the angled shape 125 of the mounting bracket 120. The handle grip portion 115 may include a cylindrical rod shaped into a semi-oval body 145 that terminates at opposing ends 150. The opposing ends 150 of the semi-oval body 145 may be received in a cavity 155 defined by the angled shape 140 of the handle bracket 135. In one aspect, the handle grip portion 115 may extend approximately normal to the handle bracket 135. In another aspect the handle grip portion 115 may be positioned at an angle less than normal to the handle bracket 135.

The handle bracket 135 may include through holes 160 formed in an apex 167 of the angled shape 140. The through holes 160 may receive a fastener 165 coupling the grip portion 115, mounting bracket 120, and handle bracket 135. The through holes may have various shapes to allow for positioning the handle grip 115 relative to the handle bracket 135. In one aspect, the handle bracket 135 may include attachment holes 170 formed thereon on opposing surfaces 175 relative to the apex 167. The harness 130 may be attached to the opposing attachment holes 170 and be tightened about the tree 110 securing the hand grip assembly 115 relative to the tree 110.

Various harnesses 130 may be utilized. For example, the harness 130 may be a strap, chain, cable, or rope. Additionally, the harness 130 may include hooks attached at ends of the harness 130 such that the hooks may be received in the opposing attachment holes 170. Other attachment features other than hooks may be attached at the ends of the harness 130 allowing attachment with the handle bracket 35.

As stated above, the mounting bracket 120 includes an angled shape. In one aspect, the angle may be from 80 to 90 degrees between opposing sides of the mounting bracket 120. In one aspect, the mounting bracket 120 may include an angle of 85 degrees between the opposing sides of the mounting bracket 120.

Figure 7:
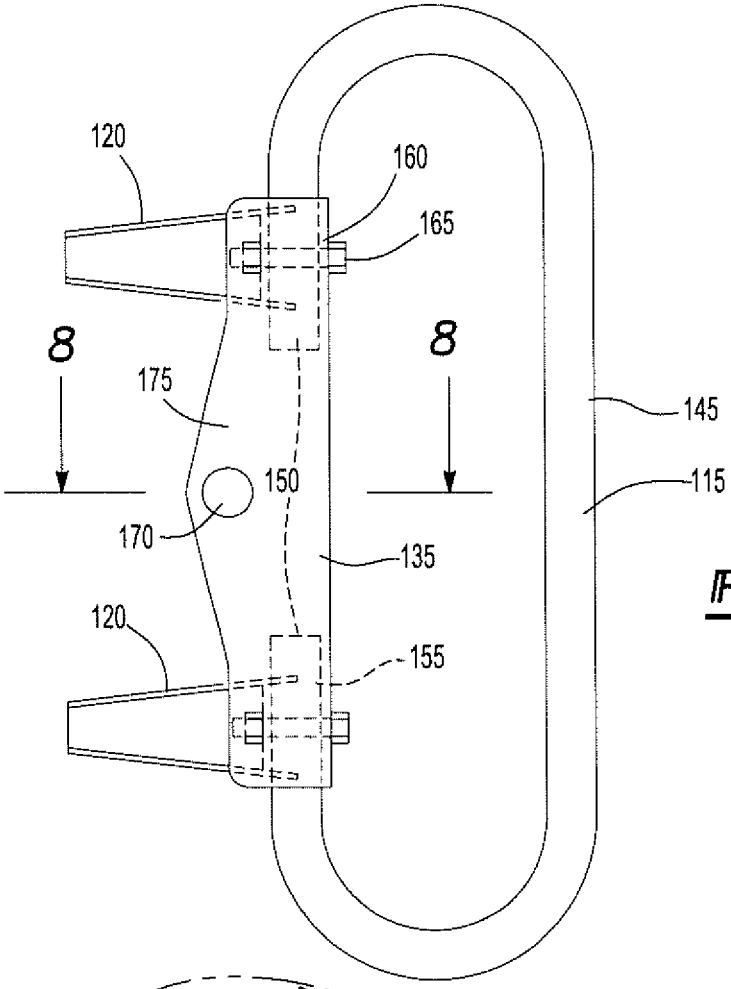
FIG. 7 is a partial sectional view of a handle grip assembly showing the handle grip assembly attached to a tree of the kit.

As shown in the depicted embodiment, a hand grip assembly 105 may include a handle grip portion 115. A handle bracket 135 may be attached to the handle grip portion 115. The at least one mounting bracket 120 may be attached to the handle bracket 135. The mounting bracket 120 includes an angled shape 125 for engaging a surface of the tree 110 as best shown in FIG. 7. A harness 130 may be attached to the handle bracket 135 such that the harness 130 may be cinched about the tree 110 securing the hand grip assembly 105 relative to the tree 110. Alternatively, the handle grip 115 may be attached to the mounting bracket 120 and the harness 130 may be connected with the mounting bracket 120 such that the harness cinches about a tree securing the mounting bracket 120 to the tree 110.

The kit when in use may include the procedure as described above with respect to the step extension assembly 110 and also include the step where a user may assemble the handle grip portion 115, at least one mounting bracket 120, and the handle bracket 135 utilizing appropriate fasteners 165 that are positioned in holes formed in the apex of the angled shapes 125, 140 of the mounting bracket 120 and handle bracket 135 respectively. In this manner, the grip portion 115, mounting bracket 120, and handle bracket 135 may be connected together.

The user may then scale a ladder 12 or other device attached to the tree 110 and attach the hand grip assembly 105 at an appropriate height to allow for secure hand support when entering and leaving a tree stand 80 attached to the tree 110. The user may attach the hand grip assembly 105 by positioning the angled surfaces 125 of the mounting brackets 120 against the tree 120 and tightening the harness 130 that is attached to the opposing attachment holes 170 of the handle bracket 35. In one aspect, a tensioning device as disclosed in U.S. Provisional Application No. 61/555,612 filed on Nov. 4, 2011 which is incorporated by reference in its entirety, may be provided and attached to the harness 130 such that a user may securely attach the hand grip assembly 105 to the tree or other object 110.

As the user tensions the harness 130 about the tree 110, the angled surface 125 of the mounting bracket 120 engages the surface of the tree 110 securely positioning the hand grip assembly 105 relative to the tree 110.

It should be realized that various shapes of the handle grip portion 115 may be utilized. For example, rectangular or other shaped handle grips may be provided. Additionally, a handle grip 115 may include a knurled surface or other gripping shape such as an indentation, bumps, or other type of surface. Additionally, the handle grip portion 115 may be provided with an additional gripping surface such as a tape or other type of implement.

The invention has been described in an illustrative manner. It is to be understood that the terminology, which has been used, is intended to be in the nature of words of description rather than limitation. Many modifications and variations of the invention are possible in light of the above teachings. Therefore, within the scope of the appended claims, the invention may be practiced other than as specifically described.

The invention claimed is:

1. An assembly comprising a tree stand and a step extension assembly, the assembly comprising:

a tree stand;

a separate step extension assembly comprising: a ladder having a plurality of rungs spaced vertically relative to each other, each of the plurality of rungs supported by a single ladder rail, and each of the plurality of rungs including a stepping area, the single ladder rail including a posterior side separated from an anterior side by side surfaces;

a bracket frame, the bracket frame including attachment portions connecting to the single ladder rail, the attachment portions including an adjustment hole receiving an adjustment fastener that passes through the adjustment hole and selectively contacts the single ladder rail vertically adjustably fixing the bracket frame along the single ladder rail;

a step base separate from the plurality of rungs of the ladder and separate from the tree stand, the step base attached to the bracket frame, the step base including a stepping surface for supporting a foot of a user;

wherein the step base is positioned laterally outboard relative to the single ladder rail and laterally adjacent one of the side surfaces of the single ladder rail and the step base extends laterally beyond the stepping area of the rungs defining an extended support for the user when entering and exiting the tree stand, the single ladder rail defining a plane which forms a first area including said one of the side surfaces, and a second area including an opposing laterally adjacent one of the side surfaces, the tree stand configured to be secured to a tree in the second area and near the opposing laterally adjacent one of the side surfaces but spaced therefrom.

2. The assembly of claim 1 wherein the bracket frame includes a rail having a planar step mounting portion and a support portion.

3. The assembly of claim 2 wherein the support portion and the mounting portion terminate at the attachment portions.

4. The assembly of claim 1 wherein the step base includes a step frame having a plurality of step rails attached within the step frame.

5. The assembly of claim 4 wherein the plurality of step rails and the step frame both include upper surfaces capable of supporting the foot of the user.

6. The assembly of claim 5 wherein the upper surface of the plurality of step rails and the upper surface of the step frame both include gripping structures formed thereon.

7. The assembly of claim 1 wherein the attachment portions include opposing sides joined by a joining surface defining a cavity that receives the single ladder rail.

8. The assembly of claim 7 wherein the opposing sides define an opening allowing the single ladder rail to be positioned within the cavity.

9. The assembly of claim 8 wherein the opposing sides include retaining holes formed there through on a common axis, the retaining holes receiving a retaining fastener.

10. The assembly of claim 9 wherein the retaining holes are positioned in the opposing sides such that the retaining fastener is positioned on an outside surface of the single ladder rail when the single ladder rail is positioned within the cavity.

11. The assembly of claim 1 wherein the adjustment hole includes threads formed therein receiving the adjustment fastener.

12. The assembly of claim 11 wherein the adjustment fastener is threaded into the adjustment hole and contacts the single ladder rail when the single ladder rail is positioned within a cavity.

13. A climbing kit, the climbing kit comprising:

a tree stand;

a step extension assembly comprising: a ladder having a plurality of rungs spaced vertically relative to each other, each of the plurality of rungs supported by a single ladder rail, and each of the plurality of rungs including a stepping area, the single ladder rail including a posterior side separated from an anterior side by side surfaces;

a bracket frame, the bracket frame including attachment portions connecting to the single ladder rail, the attachment portions including an adjustment hole receiving an adjustment fastener that passes through the adjustment hole and selectively contacts the single ladder rail vertically adjustably fixing the bracket frame along the single ladder rail;

a step base separate from the plurality of rungs of the ladder and separate from the tree stand, the step base attached to the bracket frame, the step base including a stepping surface for supporting a foot of a user;

wherein the step base is positioned laterally outboard relative to the single ladder rail and laterally adjacent one of the side surfaces of the single ladder rail and the step base extends laterally beyond the stepping area of the rungs defining an extended support for the user when entering and exiting the tree stand, the single ladder rail defining a plane which forms a first area including said one of the side surfaces, and a second area including an opposing laterally adjacent one of the side surfaces, the tree stand configured to be secured to a tree in the second area and near the opposing laterally adjacent one of the side surfaces but spaced therefrom;

a handle grip portion;

two mounting brackets connected with the handle grip portion, the mounting brackets having an angled shape for engaging a tree surface;

a harness connected with one of the two mounting brackets, the harness capable of cinching about the tree surface and securing the one of the two mounting brackets relative to the tree surface.

14. The climbing kit of claim 13 including a handle bracket attached to the handle grip portion and the two mounting brackets, the handle bracket includes an angled shape complementary with the angled shape of the two mounting brackets.

15. The climbing kit of claim 14 wherein the handle grip portion includes a cylindrical rod shaped into a semi-oval body terminating at opposing ends wherein the opposing ends of the semi-oval body are received in a cavity defined by the angled shape of the handle bracket.

16. The climbing kit of claim 14 wherein the handle bracket includes through holes formed in an apex of the angled shape of the handle bracket, the through holes receiving a fastener coupling the grip portion, two mounting brackets and handle bracket.

17. The climbing kit of claim 16 wherein the handle bracket includes attachment holes formed therein on opposing surfaces relative to the apex wherein the harness is attached to the attachment holes for securing the hand grip portion relative to the tree surface.

18. The climbing kit of claim 13 wherein the bracket frame includes a rail having a planar step mounting portion and a support portion wherein the support portion and the mounting portion terminate at the attachment portions.

19. The climbing kit of claim 13 wherein the step base includes a step frame having a plurality of step rails attached within the step frame wherein the plurality of step rails includes upper surfaces and the step frame includes an upper surface wherein said upper surfaces are configured to support the foot of the user.

20. The climbing kit of claim 19 wherein the upper surfaces of the plurality of rails and the upper surface of the step frame both include gripping structures formed thereon.

21. The climbing kit of claim 13 wherein the attachment portions include opposing sides joined by a joining surface defining a cavity that receives the single ladder rail and wherein the opposing sides define an opening allowing the single ladder rail to be positioned within the cavity.

22. The climbing kit of claim 21 wherein the opposing sides include retaining holes formed there through on a common axis, the retaining holes receiving a retaining fastener wherein the holes are positioned in the opposing sides such that the retaining fastener is positioned on an outside surface of the single ladder rail when the single ladder rail is positioned within the cavity.

* * * * *